US008167292B1

(12) United States Patent
Mucciacciaro et al.

(10) Patent No.: US 8,167,292 B1
(45) Date of Patent: May 1, 2012

(54) VISE JAW PLATES

(75) Inventors: Domenic Mucciacciaro, Boca Raton, FL (US); Alvin S. Blum, Fort Lauderdale, FL (US)

(73) Assignee: Domenic Mucciacciaro, Deerfield Beach, FL (US)

( * ) Notice: Subject to any disclaimer, the term of this patent is extended or adjusted under 35 U.S.C. 154(b) by 1260 days.

(21) Appl. No.: 11/810,039

(22) Filed: Jun. 4, 2007

Related U.S. Application Data

(63) Continuation-in-part of application No. 11/007,971, filed on Dec. 9, 2004, now abandoned, which is a continuation-in-part of application No. 10/455,062, filed on Jun. 5, 2003, now abandoned.

(51) Int. Cl.
*B25B 1/24* (2006.01)
*B25B 5/16* (2006.01)

(52) U.S. Cl. ..... 269/282; 269/262; 269/266; 269/271; 269/286

(58) Field of Classification Search ..... 269/282, 269/262, 266, 271, 276
See application file for complete search history.

(56) References Cited

U.S. PATENT DOCUMENTS

| | | | | | |
|---|---|---|---|---|---|
| 994,240 | A | * | 6/1911 | Bingham | 269/271 |
| 2,409,936 | A | * | 10/1946 | Hunt | 269/268 |
| 2,643,563 | A | * | 6/1953 | Gaudreau | 269/87.3 |
| 2,882,656 | A | * | 4/1959 | Novkov | 451/365 |
| 3,065,960 | A | * | 11/1962 | Miller | 269/276 |
| 4,216,950 | A | * | 8/1980 | Mason et al. | 269/271 |
| 4,573,669 | A | * | 3/1986 | Gerry | 269/271 |
| 4,685,437 | A | * | 8/1987 | Tanaka et al. | 123/549 |
| 4,861,010 | A | * | 8/1989 | Neil | 269/282 |
| 5,715,589 | A | * | 2/1998 | Teague | 29/559 |
| 5,765,822 | A | * | 6/1998 | Mead | 269/96 |

* cited by examiner

*Primary Examiner* — Bryan R Muller
(74) *Attorney, Agent, or Firm* — Alvin S. Blum

(57) ABSTRACT

Jaw plates for removably attaching to the jaws of machine vises extend above the top of the jaw to hold taller workpieces. They are made from aluminum alloy for readily machining to conform to contours of a workpiece not easily held by flat jaw faces. They are sections cut from a special extrusion for enhanced physical properties and economy of production. Through holes are drilled for fastening to the jaw face. The plate has a planar vertical face for lying flat on the vertical jaw face. A second face engages the top horizontal face of the jaw. A groove between the two plate faces ensures the second face engages the horizontal face of the jaw away from the intersection of the faces. Alternatively, material on the plate may conform to the workpiece when hot and retain shape when cool.

8 Claims, 6 Drawing Sheets

VISE JAW PLATES

This application is a continuation in part of application Ser. No. 11/007,971 filed Dec. 9, 2004 now abandoned that is a continuation in part of application Ser. No. 10/455,062 filed Jun. 5, 2003 now abandoned.

FIELD OF THE INVENTION

This invention relates generally to machine vises, and more particularly to plates for removably attaching to the faces of a machine vise for enhanced holding of a workpiece.

BACKGROUND OF THE INVENTION

Vises that mount on a machine tool support a workpiece in a secure position while being acted upon by the machine. They generally have flat opposing faces called jaws that are brought toward one another with the workpiece in between with sufficient force to resist the forces of machining on the workpiece. The jaws are generally provided with means for attaching a machinable jaw plate to their face. The plate is machined to fit the contour of the work piece so that the vise can better hold a workpiece that is not effectively held by parallel flat faces. The machinist generally starts with a block of aluminum. It is then cut to size, and holes bored to correspond to the vise jaw bolt holes. The exposed faces are then machined to conform to workpiece surfaces that are to be held. Preparing the plates for machining is labor intensive, requiring the services of the skilled machinist at the shop, and the plates may not be held securely by the bolts alone. U.S. Pat. No. 994,240 issued Jun. 6, 1911 to Bingham teaches a tongue projecting from the front face of a vise jaw more than half way down the jaw face, and a removable jaw of a machinable material to be bolted onto the tongue. The plate has a slot milled in its face to receive the tongue so that the top and bottom of the slot are held securely by the top and bottom of the tongue.

SUMMARY OF THE INVENTION

The invention provides machinable L-shape plates that are already prepared for removably attaching to the face of a machine vise that has a planar front face, while providing extra security by a leg of the plate that engages the uppermost surface of the vise. This reduces the labor cost of machining, since the machinist need only machine the face of the plate to conform to the workpiece, as required. The plates of the invention are produced by extruding an aluminum alloy in an L shape. Sections of the extrusion are cut to the width of the face of the vise. Then holes in the section are drilled to correspond to the mounting holes in the particular vise model. The plate is then ready for shipment. The extrusion process is selected because it is designed to provide excellent hard surface properties on the surfaces that are in contact with the vise surfaces. The extrusion process is also designed to consistently provide the required internal structural strength that resists yielding under stress. The stresses imposed on the junction between the two legs of the L-shape plate of the invention when the plate is tightly clamped and machining forces are applied would sometimes result in fractures that can be dangerous when casting or molding methods of construction are employed with their less consistent quality.

The angle between the front face of the jaw and the top of the vise is precisely controlled to exactly 90 degrees. If the angle between the two inside faces of the extrusion that are to contact the vise are greater than 90 degrees, the intersection of the inside faces will engage the upper edge of the jaw, and the balance of the horizontal face of the plate will extend at an angle above the top of the vise. It will be unsupported. Machining and clamping forces may bend the plate down toward the top of the vise an undetermined amount. This unpredictable movement of the workpiece is unacceptable. When extruding material to these shapes, it is difficult to hold angles exactly. The angle formed between the legs is limited to no more than ninety degrees and no less than eighty-nine degrees. This ensures that the far edge of the plate's horizontal face will engage the top of the vise, thereby resisting flexing of the plate. To further ensure that that the far edge of the horizontal face is free to engage the top of the vise, an elongate groove is provided at the junction of the two inside faces of the legs. This prevents any poorly formed extrusion junction from engaging the edge of the jaw.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Figure 2:
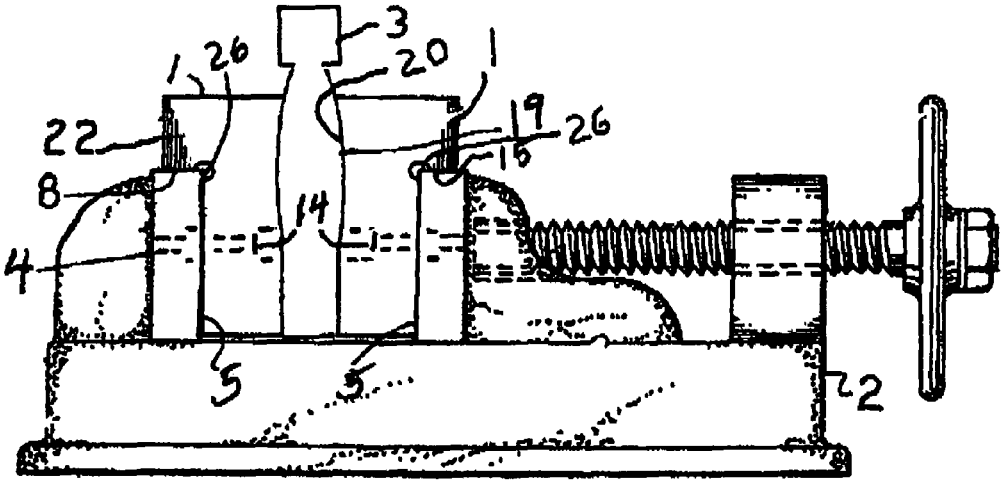
FIG. 2 is a side elevation view of a machine vise with jaw plates of the invention and a work piece clamped ready for machining.
Figure 1:
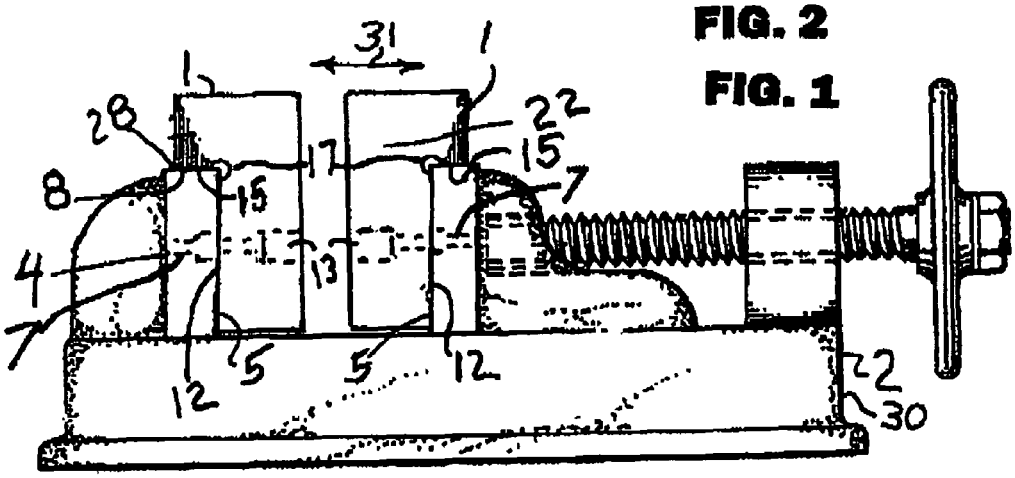
FIG. 1 is a side elevation view of a machine vise with jaw plates of the invention in place.
Figure 3:
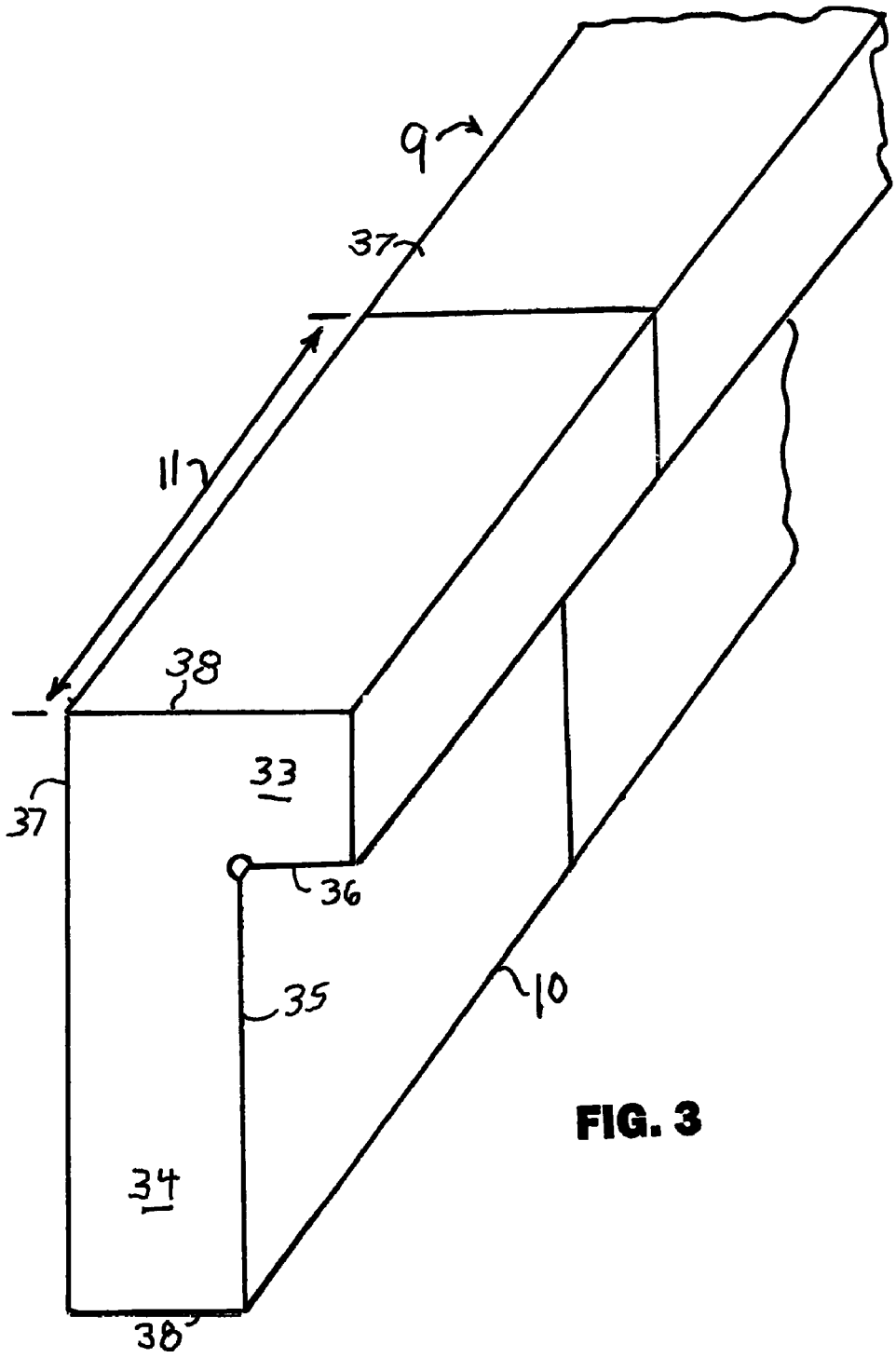
FIG. 3 is a perspective view of an aluminum extrusion ready for cutting out a section to form a jaw plate of the invention.
Figure 4:
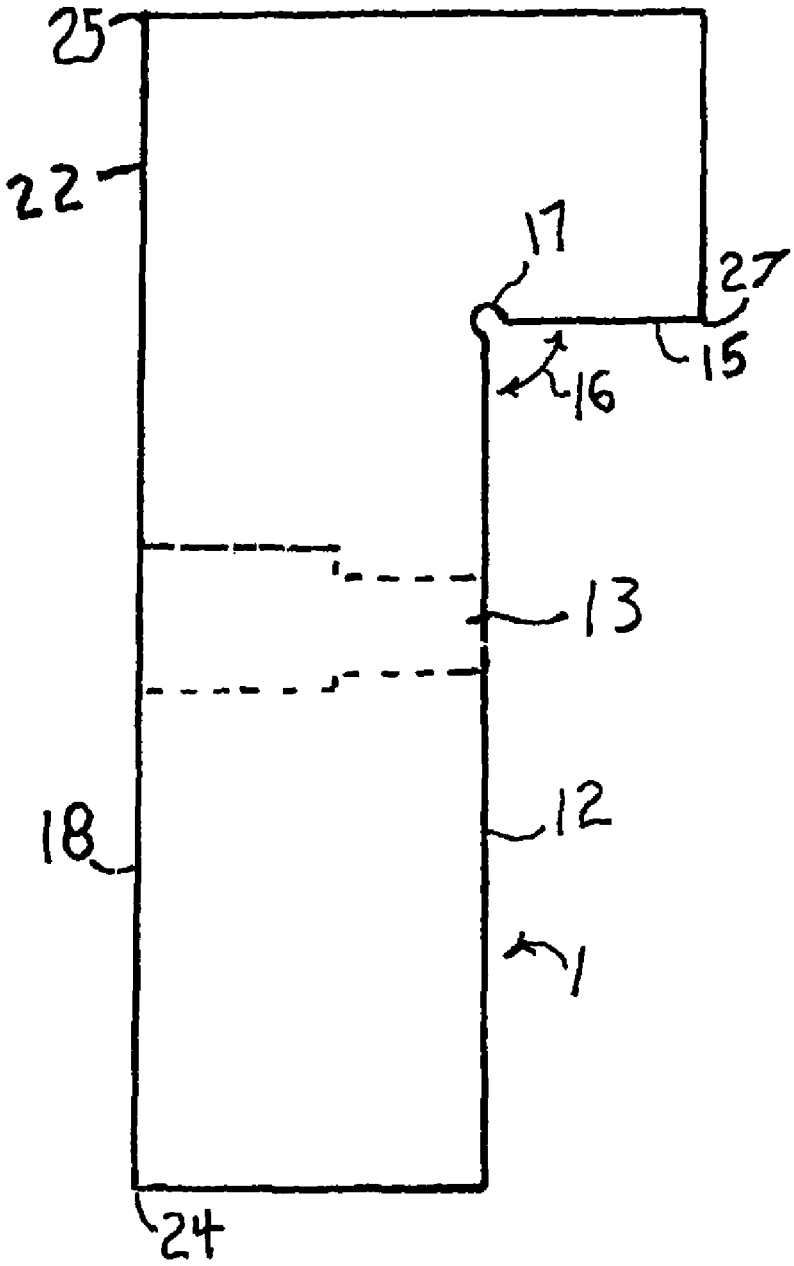
FIG. 4 is a side elevation view of a jaw plate of the invention.

Referring now first to the drawing FIGS. 1-6, a machine vise 2 has a vise base 30 supporting jaws 4. Each jaw has a single planar workpiece engaging face 5 that can be moved in a first direction 31 toward one another to securely clamp a workpiece against the planar workpiece-engaging opposed faces 5. Each jaw has a single planar top surface 8 that is the vise portion spaced the greatest distance from the base. When the contours of the workpiece 3 are not conducive to secure clamping between planar faces, jaw plates 1 of the invention may be mounted on the jaws 4 by screw fasteners 14. The jaw plates 1 may be economically made by cutting a section 10 from an elongate extrusion 9 of an easily machinable aluminum alloy. The extrusion includes a first planar inside face 35 and second planar inside face 36 joined transversely to each other, two outside faces 37 joined transversely to each other, and two joining faces 38 joining the inside faces to the outside faces to thereby define an L-shape section of uniform cross section having a first leg 33 and a second leg 34 transverse to the first leg.

The length 11 of the section 10 corresponds substantially to the width (not shown) of the jaw. The jaw plate 1 has a planar face 12 dimensioned to lie flat against the planar vertical workpiece-engaging face 5 of the jaw 4, when fasteners 14, passing through fastener-receiving countersunk holes 13 into threaded holes 7 in the jaw, hold the plate in working position. A second planar face 15 is disposed at an angle 16 so as to engage the planar top surface 8 of the jaw when the plate is in working position on the jaw. An elongate groove 17, positioned at the intersection of the first and second faces, separates the two faces. A third face portion 18 of the plate is opposed to the first face of the plate. It is readily recessed by machining anywhere from its top edge 25 to its bottom edge 24 to a shape 19 to conform to the contour 20 of the workpiece. There are no projections from the third face portion, since they might interfere with engagement of the workpiece. The aluminum of the plate, being softer than the steel of the jaw, is unlikely to damage a cutting tool if accidental contact is made.

The upper portion 22 of the plate extends above the top 8 of the jaw. This enables secure gripping of certain workpieces. Any torque on the upper portion 22 during clamping and machining causes the second face 15 to be forced against the top surface 8 of the jaw to thereby stabilize its position. It is difficult to hold an inside corner to exact dimensions during extrusion. The groove 17 enables the invention to be manufactured by extrusion with its low cost and superior surface properties and strong internal structure. Groove 17 between faces 12 and 15 prevents the upper forward edge 26 of the jaw from engaging the face 8. The edge 27 of face 15 engages face 8 at a position 28 away from the forward edge 26. It is most desirable for the angle 16 to be exactly 90 degrees. Since it is difficult to hold extrusions to exact dimensions, a tolerance for the angle 16 is provided to be greater than 89 degrees and no more than ninety degrees. When the angle 16 is less than 90 degrees, the far edge 27 of face 15 engages the top face 8 of the jaw before any clamping force is applied, thereby stabilizing the top portion 22 of the plate.

By making the plate from an aluminum extrusion, high strength internal structure to resist fracture and desirable surface properties in contact with steel faces can be assured consistently from a controlled extrusion process that is not assured by the more expensive molding and casting processes.

Figure 5:
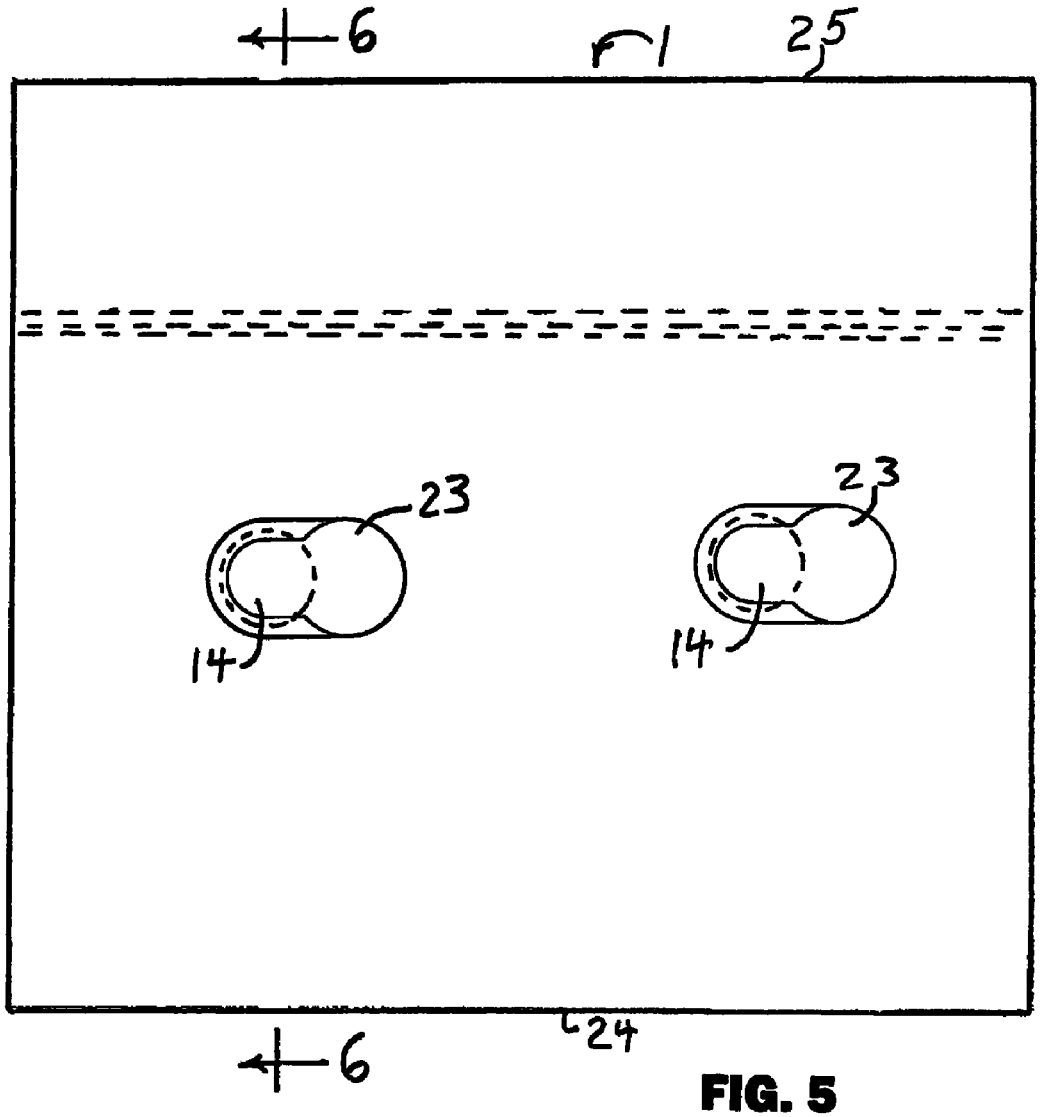
FIG. 5 is a front elevation view of a jaw plate of the invention.
Figure 6:
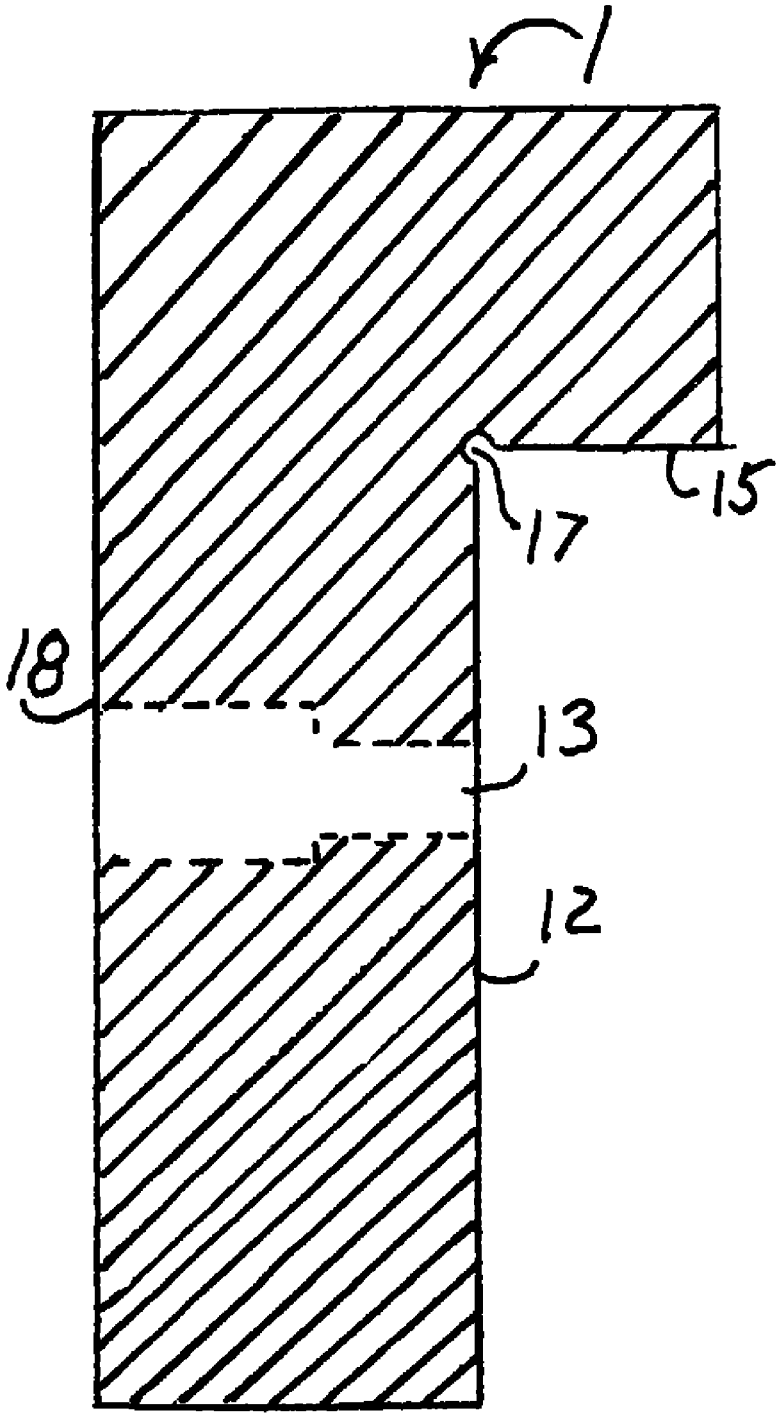
FIG. 6 is a sectional view taken through line 6-6 of FIG. 5.

As shown in FIG. 5, keyhole apertures 23 may be provided in the plates so that the fasteners 14 (shown in phantom) need not be completely removed and replaced when changing plates.

Figure 7:
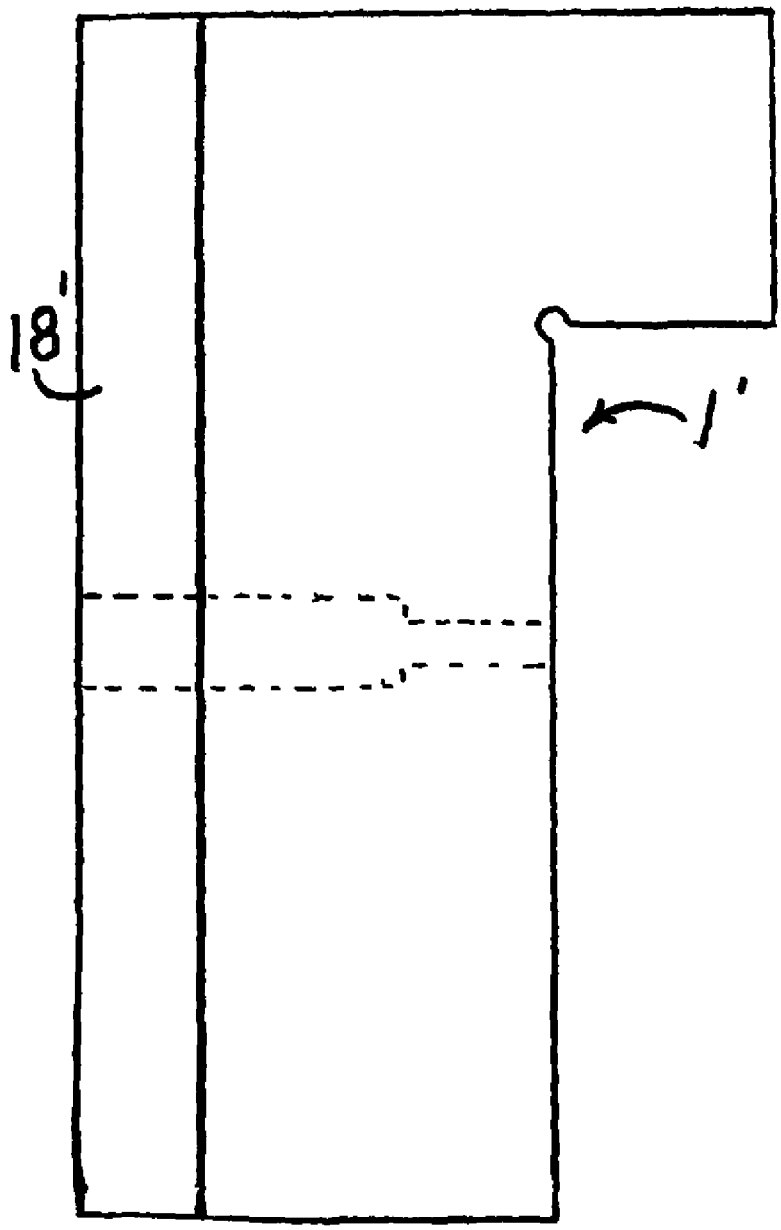
FIG. 7 is a side elevation view of another embodiment of the invention.

Referring now to FIG. 7, another embodiment 1' of the invention is shown in which the third face portion 18' is comprised of a thermoplastic material that is readily deformed at moderately elevated temperature, and becomes rigid at room temperature. The ethylene vinyl acetate, trade name "ELVAX" by DUPONT CORP is exemplary of such materials. It may be heated by a stream of hot air from a hair dryer and then pressed against a workpiece. The face portion 18' will retain the new shape when cooled to room temperature. The jaw plate may be reused for a different workpiece by reheating it.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A jaw plate for holding a workpiece of a particular contour when the plate is removably mounted on a jaw of a machine vise, the jaw mounted on a vise base for movement in a first direction, the jaw having a planar workpiece-clamping face disposed orthogonal to the first direction, the jaw having at least two transverse fastener-receiving holes therein and a planar top surface disposed orthogonal to, and meeting the workpiece-clamping face, the jaw plate comprising:

a) first and second planar inside faces joined transversely to each other, two outside faces joined transversely to each other, and two joining faces joining the inside faces to the outside faces to thereby define an L-shape cross section contour to the entire jaw plate, the cross section having a first leg and a second leg transverse to the first leg composed of an aluminum alloy;

b) the first planar inside face having a surface dimensioned to lie flat against the workpiece-clamping face of the jaw;

c) through holes in the first leg corresponding in position to said at least two transverse fastener-receiving holes such that the section may be securely mounted to said jaw by fasteners;

d) an elongate groove positioned at the intersection of the first and second inside faces to separate the two faces to ensure that the second inside face engages the planar top surface of the jaw;

e) the second planar inside face having a surface dimensioned to engage the planar top surface, the second planar inside face being disposed at an angle of not greater than ninety and not less than eighty-nine degrees to the first planar inside face for engaging said planar top surface at a location away from the groove at the junction of the two inside faces when the plate is mounted on the jaw by fasteners; and f) the outside surface of the first leg being opposed to the first surface, the outside surface of the first leg arranged to be readily modifiable from the a top edge thereof to a bottom edge thereof to conform to said particular contour of the workpiece for enhanced secure holding of the workpiece during machining.

2. The jaw plate according to claim 1 in which the broad outside surface is comprised of a thermoplastic material that is modifiable by pressing against said contour while hot to achieve a shape corresponding to the contour, and that retains that shape when cooled and rigid.

3. The jaw plate according to claim 2 in which the through holes include keyhole slots to enable the jaw plate to be mounted and removed without complete removal of the fasteners.

4. The jaw plate according to claim 1 in which the through holes include keyhole slots to enable the jaw plate to be mounted and removed without complete removal of the fasteners.

5. A process for fabricating a low cost jaw plate for holding a workpiece of a particular contour when the plate is removably mounted on a jaw of a machine vise, the jaw having a planar workpiece-clamping face, the jaw having a particular width with at least two transverse fastener-receiving holes therein and a planar top surface disposed orthogonal to, and meeting the workpiece-clamping face, the process comprising the steps of:

a) extruding an aluminum alloy into an elongate L shape extrusion having;

first and second planar inside faces joined transversely to each other, two outside faces joined transversely to each other, and two joining faces joining the inside faces to the outside faces to thereby define an L-shape cross section contour having a first leg and a second leg transverse to the first leg with an elongate groove positioned at a junction of the first and second inside faces;

b) cutting the extrusion into sections having lengths substantially equal to the particular width:

c) providing through holes transversely in the first leg of each section corresponding in position to said at least two transverse fastener-receiving holes such that the section may be securely mounted to said jaw by fasteners to become a removably mounted vise plate having the following features;

i) the first planar inside face having a non-machined surface dimensioned to lie flat against the workpiece-clamping face of the jaw;

ii) an elongate groove positioned at the intersection of the first and second inside faces to separate the two faces to ensure that the second inside face engages the planar top surface of the jaw;

iii) the second planar inside face having a non-machined surface dimensioned to engage the planar top surface, the second planar inside face being disposed at an angle of not greater than ninety and not less than eighty-nine degrees to the first planar inside face for engaging said planar top surface at a location away from the groove at the junction of the two inside faces when the plate is mounted on the jaw by fasteners; and iv) a outside surface of the first leg opposed to the first surface, the outside surface of the first leg arranged to be readily modifiable from the a top edge thereof to a bottom edge thereof to conform to said particular contour of the workpiece for enhanced secure holding of the workpiece during machining.

6. The process according to claim 5 in which the broad outside surface is comprised of a thermoplastic material that is modifiable by pressing against said contour while hot to achieve a shape corresponding to the contour, and that retains that shape when cooled and rigid.

7. The process according to claim 6 in which the through holes include keyhole slots to enable the jaw plate to be mounted and removed without complete removal of the fasteners.

8. The process according to claim 5 in which the through holes include keyhole slots to enable the jaw plate to be mounted and removed without complete removal of the fasteners.

* * * * *